US008276575B1

(12) United States Patent
Gillig

(10) Patent No.: US 8,276,575 B1
(45) Date of Patent: Oct. 2, 2012

(54) ARCHERY BOWSTRING RELEASE

(75) Inventor: Jason Gillig, Neenah, WI (US)

(73) Assignee: Tru-Fire Corporation, North Fond Du Lac, WI (US)

( * ) Notice: Subject to any disclaimer, the term of this patent is extended or adjusted under 35 U.S.C. 154(b) by 297 days.

(21) Appl. No.: 12/618,831

(22) Filed: Nov. 16, 2009

(51) Int. Cl.
*F41B 5/14* (2006.01)
*F41B 11/00* (2006.01)

(52) U.S. Cl. ..... 124/35.2; 124/35.1; 124/31

(58) Field of Classification Search ..... 124/31, 124/35.1, 35.2; 74/503, 519, 520; 403/119, 403/161, 162, 289, 290, 359.1
See application file for complete search history.

(56) References Cited

U.S. PATENT DOCUMENTS

| | | | | | |
|---|---|---|---|---|---|
| 1,542,159 | A * | 6/1925 | Maxwell | 124/35.2 |
| 2,000,015 | A * | 5/1935 | Flury | 124/35.2 |
| 2,488,597 | A * | 11/1949 | Konold | 124/35.2 |
| 2,936,749 | A * | 5/1960 | Chellstorp | 124/35.1 |
| 3,948,243 | A * | 4/1976 | Gazzara, Sr. | 124/35.2 |
| 3,954,095 | A * | 5/1976 | Lewis | 124/35.2 |
| 4,160,437 | A * | 7/1979 | Fletcher | 124/35.2 |
| 4,282,851 | A * | 8/1981 | Lyons | 124/35.2 |
| 4,926,835 | A * | 5/1990 | Peck | 124/35.2 |
| 5,168,693 | A * | 12/1992 | Ingvardsen | 56/400.04 |
| 5,247,921 | A * | 9/1993 | Todd | 124/35.2 |
| 5,263,466 | A * | 11/1993 | Peck | 124/35.2 |
| 5,365,911 | A * | 11/1994 | Todd | 124/35.2 |
| 5,370,102 | A * | 12/1994 | Peck | 124/35.2 |
| 5,546,924 | A * | 8/1996 | Todd | 124/35.2 |
| 5,564,407 | A * | 10/1996 | Linsmeyer | 124/35.2 |
| 5,582,158 | A * | 12/1996 | Linsmeyer | 124/35.2 |
| 5,680,852 | A * | 10/1997 | Tentler et al. | 124/35.2 |
| 5,884,614 | A * | 3/1999 | Darlington et al. | 124/25 |
| 6,135,667 | A * | 10/2000 | Debisschop | 403/290 |
| 6,763,819 | B2 * | 7/2004 | Eckert | 124/35.2 |
| 7,240,672 | B2 * | 7/2007 | Peck et al. | 124/35.2 |
| 7,654,254 | B1 * | 2/2010 | Rentz et al. | 124/35.2 |
| 2002/0162546 | A1 * | 11/2002 | Mugg | 124/35.2 |
| 2003/0019488 | A1 * | 1/2003 | Eckert et al. | 124/35.2 |
| 2006/0042612 | A1 * | 3/2006 | Stanislawski | 124/35.2 |
| 2007/0181113 | A1 * | 8/2007 | Porter | 124/35.2 |
| 2008/0202487 | A1 * | 8/2008 | Maleski et al. | 124/25 |

* cited by examiner

*Primary Examiner* — Gene Kim
*Assistant Examiner* — John E Simms, Jr.
(74) *Attorney, Agent, or Firm* — Craig A. Fieschko, Esq.; DeWitt Ross & Stevens S.C.

(57) ABSTRACT

An archery bowstring release includes a pair of bowstring-gripping jaws actuatable by a trigger, with the trigger and jaws both being pivotally linked to the housing. A cam situated within the housing has a trigger cam pivot which translates and rotates with respect to the trigger, such that the cam is urged by actuation of the trigger to open and close the jaws. The forward part of the housing bearing the jaws may be rotatable with respect to the rear part of the housing, such that the plane in which the jaws move can be rotated with respect to the plane in which the trigger moves.

23 Claims, 8 Drawing Sheets

ARCHERY BOWSTRING RELEASE

FIELD OF THE INVENTION

This document concerns an archery bowstring release.

BACKGROUND OF THE INVENTION

Bowstring releases are devices commonly used by archers to grasp a bowstring and then release it (after the bowstring has been pulled) to increase the accuracy of the archer's shot, and to increase comfort to the archer. Releases are often provided in the form of hand-held or hand-mounted jaws which grip the bowstring, and which can be actuated by the archer via a trigger. Examples of prior bowstring releases can be found in U.S. Pat. Nos. 5,564,407 and 5,582,158 to Linsmeyer, U.S. Pat. No. 6,763,819 to Eckert, and U.S. Pat. No. 7,240,672 to Peck et al., the contents of which should be regarded as part of this document as if they were appended thereon.

Many prior releases tend to provide less than ideal performance, primarily owing to two reasons. Initially, owing to manufacturing tolerances and/or owing to their jaw actuation mechanisms, the movement of their jaws is unequal (i.e., the jaws do not move symmetrically by the same distances, at the same times). This can lead to decreased shooting accuracy as one jaw releases the bowstring, and the bowstring "rolls off" the other jaw. Secondly, again owing to manufacturing tolerances and/or owing to jaw actuation schemes, prior releases tend to lack smooth actuation: pulling the trigger often leads to a clicking or grinding effect as the actuation mechanism works to open the jaws. Apart from generating unwanted noise, this too can generate inaccuracies with shooting. It would therefore be useful to have bowstring releases which address these problems.

SUMMARY OF THE INVENTION

The invention involves archery bowstring releases which at least partially address the foregoing drawbacks. To give the reader a basic understanding of some of the advantageous features of the releases, following is a brief summary of preferred versions of the releases, with reference being made to the accompanying drawings to enhance the reader's understanding. Since this is merely a summary, it should be understood that more details regarding the preferred versions of the releases may be found in the Detailed Description set forth elsewhere in this document. The claims set forth at the end of this document then define the various versions of the releases in which exclusive rights are secured.

Referring to FIGS. 1A-1D, which illustrate a first version of the archery bowstring release at 100, and/or FIGS. 2A-2D, which illustrate a second version of the archery bowstring release at 200, the archery bowstring release 100/200 includes a housing 102/202, a pair of jaws 104/204, a cam 106/206, and a trigger 108/208. Each of these components and their functions will now be discussed in turn.

The jaws 104/204 each have a jaw tip end 110/210 and a jaw tail end 112/212 (see particularly FIGS. 1B-1D and 2A-2D), and are rotationally mounted with respect to each other, preferably about a common jaw pivot 114/214 fixed with respect to the housing 102/202, such that the jaws 104/204 rotate with respect to the housing 102/202. In the drawings, when such rotation occurs, the jaw tip ends 110/210 move apart as the jaw tail ends 112/212 move together. The jaws 104/204 are preferably identical such that they can be manufactured using the same equipment and processes, and therefore are more likely to have the same tolerances. The jaws 104/204 are also preferably formed so that one jaw 104/204 has its tip and tail ends 110/210 and 112/212 both resting on one side of an axis extending through the jaw pivot 114/214 (and through the cam 106/206), and the other jaw 104/204 has its tip and tail ends 110/210 and 112/212 resting on the opposite side of the axis (i.e., the lengths of the jaws 104/204 preferably pivot about the jaw pivot 114/214 with more of a rocker motion than a scissors motion).

The cam 106/206 is at least partially situated within, and is movable with respect to, the housing 102/202, and has a driving surface 116/216 fit between the jaw tail ends 112/212, wherein the driving surface 116/216 acts on the jaw tail ends 112/212 to rotate the jaws 104/204 when the cam 106/206 moves (compare FIGS. 1C-1D and 2C-2D). The trigger 108/208 is pivotally linked to a trigger housing pivot 118/218 fixed with respect to the jaw pivot 114/214 (and more generally, with respect to the housing 102/202). The trigger 108/208 is also pivotally linked to the cam 106/206, preferably at a trigger cam pivot 120/220 spaced from the trigger housing pivot 118/218. Most preferably, the trigger 108/208 bears an elongated trigger slot 122/222, wherein the trigger cam pivot 120/220 is rotatably and translatably situated within the trigger slot 122/222. Pulling the trigger 108/208 rotates the trigger 108/208 about the trigger housing pivot 118/218, and at the same time acts on the trigger cam pivot 120/220 to translate the cam 106/206 with respect to the jaws 104/204. As seen in FIGS. 1C-1D and 2C-2D, when the cam 106/206 is urged away from the jaw tail ends 112/212 by the trigger 108/208, the jaws 104/204 open under the force of a jaw spring 124/224 situated therebetween, thereby releasing any bow string grasped between the jaw tip ends 110/210.

To review the exemplary releases 100 and 200 in greater detail, the cam 106/206 preferably has a pair of cam legs 126/226 extending rearwardly away from the cam driving surface 116/216 (see particularly FIGS. 1B and 2B), with a cam slot 128/228 being defined between the cam legs 126/226. The trigger 108/208 is then fit within the cam slot 128/228 with the trigger cam pivot 120/220 extending between the cam legs 126/226, and through the cam slot 128/228, such that when the trigger 108/208 pivots about its trigger housing pivot 118/218, the cam 106/206 is urged by the trigger cam pivot 120/220 to translate within the housing 102/202 with respect to the jaws 104/204. At the same time, the trigger cam pivot 120/220 both rotates and translates within a trigger slot 122/222 defined in the surface of the trigger 108/208 (see also FIGS. 1C-D and 2C-D). Looking back to FIGS. 1B-1D and 2B-2D, an elongated cam channel 130/230 is also defined in the cam 106/206, preferably in the outer surface of the cam 106/206, wherein the trigger housing pivot 118/218 is situated. The trigger housing pivot 118/218, being fixed with respect to the housing 102/202 with the trigger 108/208 pivoting about the trigger housing pivot 118/218, therefore serves to help restrain the cam 106/206 to translational motion within the housing 102/202 via the travel of the trigger housing pivot 118/218 within and between the ends of the cam channel 130/230. If desired, an optional cam spring 132/232 can bias the cam 106/206 forwardly or rearwardly, with FIGS. 1C-D and 2C-D showing a cam spring 132/232 between the housing 102/202 and a rear cam surface 134/234 to urge the cam 106/206 forwardly, and thus urge the cam 106/206 toward the jaw tail ends 112/212 to close the jaws 104/204.

Referring particularly to FIGS. 1C and 2C, a trigger adjustment member 136/236 can be provided which adjustably extends from the trigger 108/208, whereby adjusting its degree of extension can reset the amount of "pull" on the trigger 108/208 needed to open the jaws 104/204. To illustrate, looking to FIGS. 1C and 2C, if the trigger adjustment member 136/236—here provided as a set screw—is unscrewed to engage the housing 102/202 (i.e., if unscrewed to extend further rightwardly from the trigger 108/208), lesser pull is needed to actuate the jaws 104/204. Such a trigger adjustment member 136/236 could instead extend from the housing 102/202 to engage the trigger 108/208, and its extension from the housing 102/202 could be varied to adjust the amount of trigger pull.

The releases 100 and 200 offer a variety of advantages. Initially, the use of identical or symmetrical jaws 104/204 which move about a common jaw pivot 114/214 helps to promote equal jaw movement as the jaws 104/204 are actuated by the cam 106/206, which in turn helps to avoid irregularities in release of a bowstring that may occur where one jaw's movement is dissimilar to the other's. The use of a single common jaw pivot 114/214 is by itself useful, since the use of separate jaw pivots increases the likelihood of unequal jaw movement where the jaws and/or their pivots have different tolerances. Further, the use of jaws 104/204 configured as in the drawings allows for the jaws 104/204 to open very widely, which in turn makes it easier for the archer to insert a bow string. The cam driving surface 116/216 and the jaw tail ends 112/212 may be provided with large contact/bearing areas, allowing force from the cam driving surface 116/216 to be evenly applied to the jaw tail ends 112/212. Also, the jaws 104/204, cam 106/206, and trigger 108/208 always remain in contact during actuation of the jaws 104/204, and there is no sudden impact of parts, thereby providing noise-free (or virtually noise-free) operation. In this respect, the releases have exceedingly "smooth" operation: the rotation and translation of the trigger cam pivot 120/220 within the trigger slot 122/222 fluidly converts the pivoting of the trigger 108/208 into translation of the cam 106/206 (and in turn into pivoting of the jaws 104/204) without binding, as is common in prior releases which rely on fixed-length linkages for actuation, and without the "clicking" or "grinding" common in the operation of prior releases. The configuration of the cam 106/206, with the cam legs 126/226 being separated by a cam slot 128/228 wherein the trigger 108/208 pivots, and with the trigger 108/208 being pivotally connected with respect to the housing 102/202 at a trigger housing pivot 118/218 situated within a cam channel 130/230, also allows for an exceptionally compact, low-diameter release with few parts.

Further features, functions, and advantages of the invention will be apparent from the remainder of this document in conjunction with the associated drawings.

DETAILED DESCRIPTION OF PREFERRED VERSIONS OF THE INVENTION

To expand on the discussion above, each of the bowstring releases 100 and 200 will now be discussed in turn in greater detail.

Figure 1A:
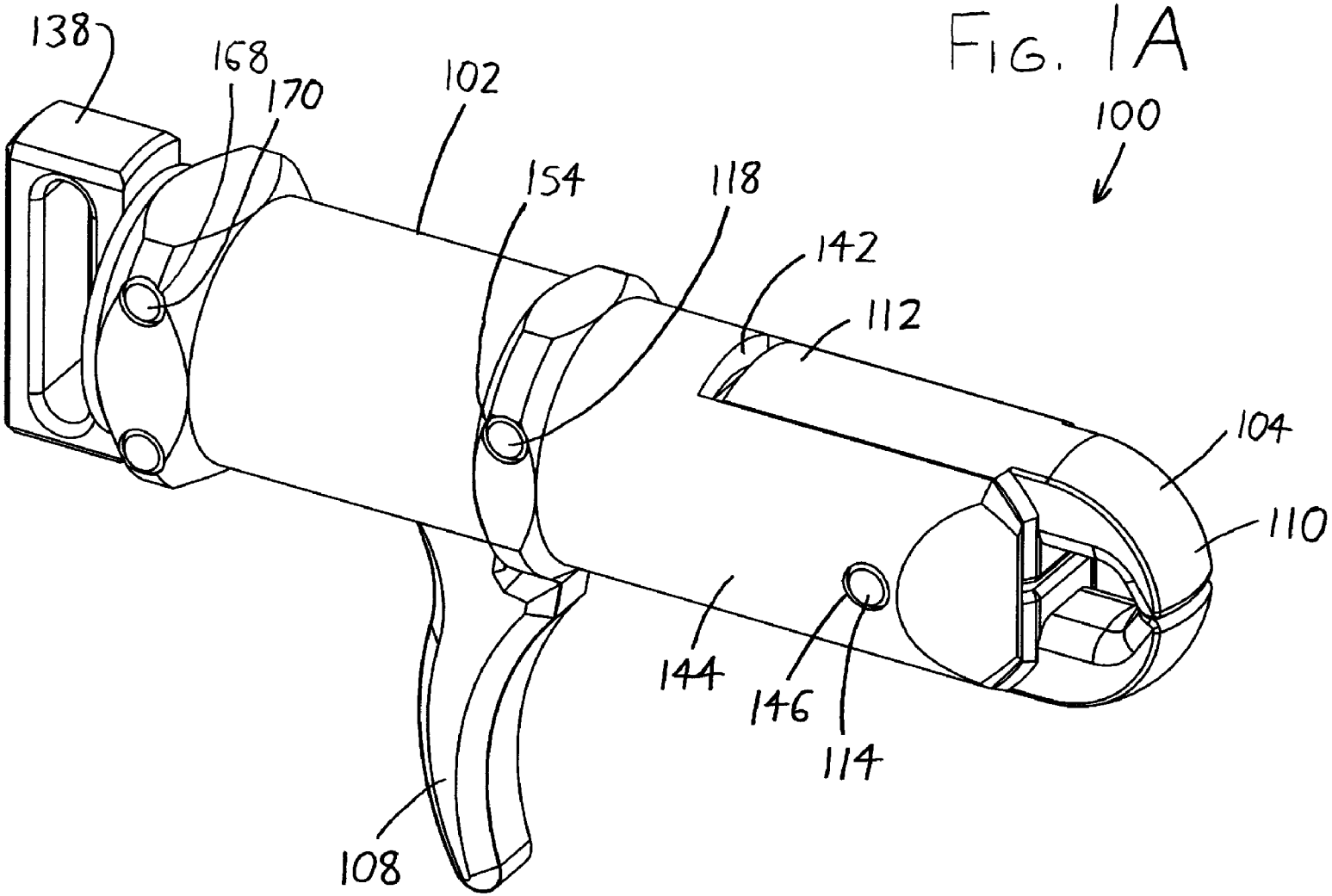
FIG. 1A is a simplified perspective view of a first version of a bowstring release 100 exemplifying the invention, showing the jaws 104 in a closed state before the trigger 108 is pulled.

Looking initially to FIG. 1A for an assembled view of the bowstring release 100, the jaws 104 are shown rotatably pinned to the housing 102 by the jaw pivot 114, and the trigger 108 is shown rotatably pinned with respect to the housing 102 by the trigger housing pivot 118. The housing 102 includes a release mount 138 rotatably mounted to its rear end, with the release mount 138 allowing easy attachment of the bowstring release 100 to a wrist band/wrist strap, glove, or other arm mounting means for anchoring the bowstring release 100 to a user's hand, wrist, or arm. Examples of wrist bands/wrist straps suitable for use with the bowstring release 100 can be found in, for example, U.S. Pat. Nos. 7,320,318 and 7,422,008, and in the patents referenced therein. The bowstring release 100 is not limited to use with these arm mounting means, and others may be used instead, and the form of the release mount 138 may be varied as desired to achieve the desired attachment to the desired arm mounting means. As another example, the release mount 138 could alternatively take the form of a handle which could be grasped by some of the user's fingers, with the user's trigger finger then reaching from the handle to the trigger 108.

Figure 1B:
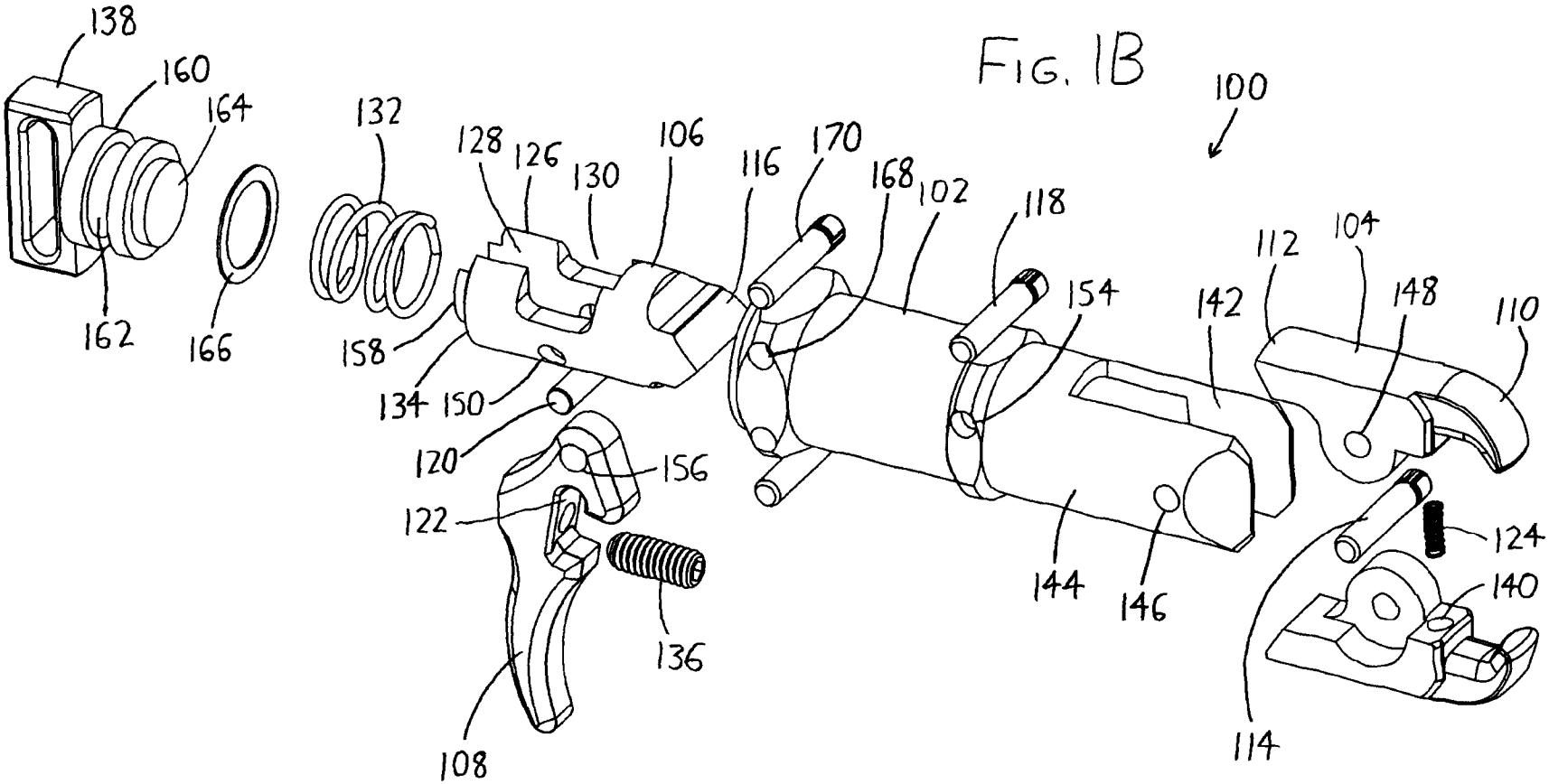
FIG. 1B is an "exploded" (disassembled) view of the bowstring release 100 of FIG. 1A.
Figure 1C:
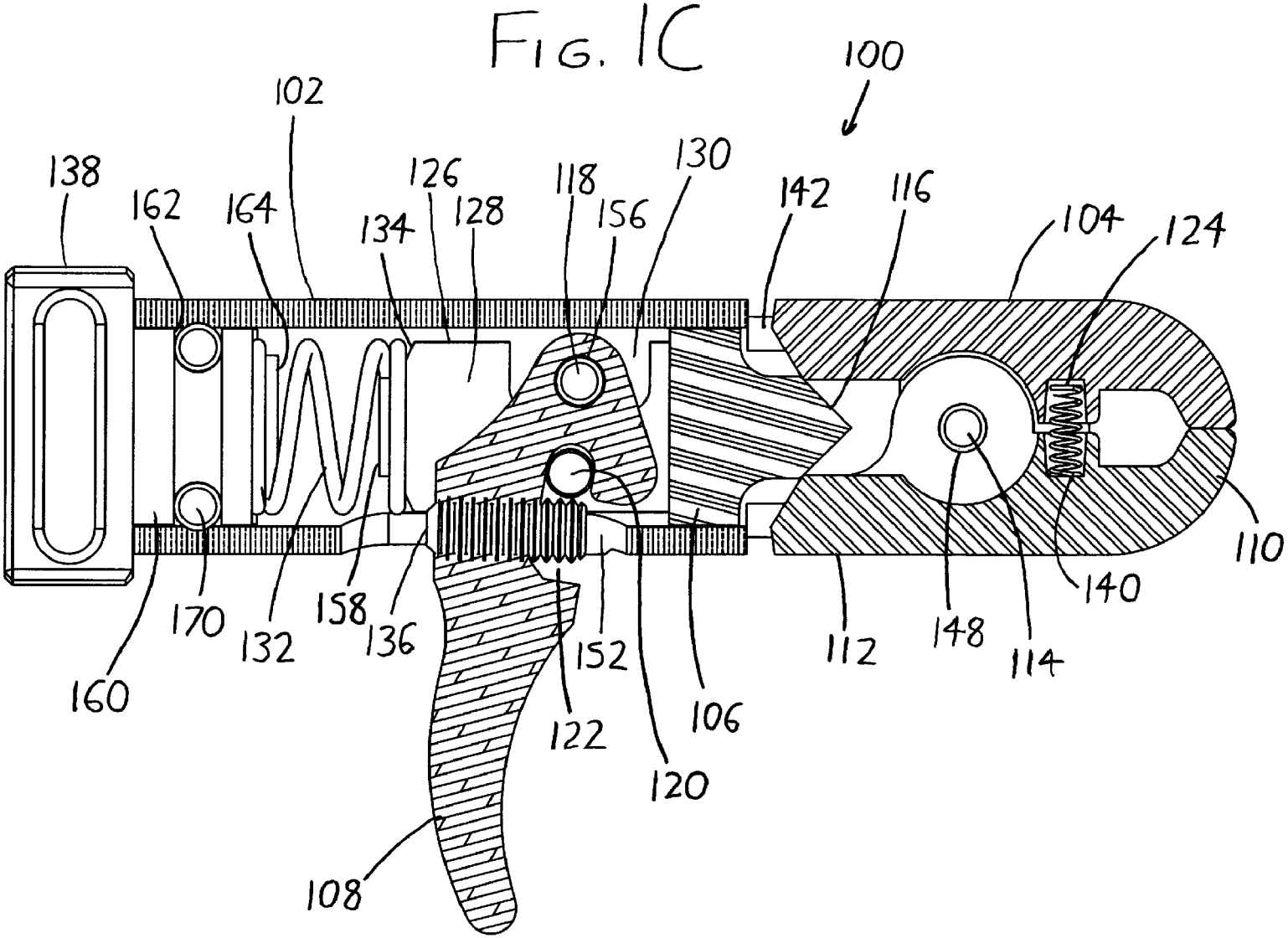
FIG. 1C is a sectional view of the bowstring release 100 of FIG. 1A, showing the bowstring release 100 bisected along a plane extending along the length of the bowstring release 100, and showing the jaws 104 in a closed state before the trigger 108 is pulled.

Turning next to FIG. 1B, the bowstring release 100 is shown in greater detail in disassembled form. The jaws 104 each include a shallow hole 140 which serves as a jaw spring mount, such that when the jaws 104 are brought together with the jaw spring 124 situated within the jaw spring mounts 140, the jaw spring 124 is retained between the jaws 104 as they open and close. A jaw slot 142 is defined in a forward end of the housing 102, with the jaw slot 142 being defined between a pair of spaced housing legs 144. The jaws 104, with the jaw spring 124 therebetween, are inserted within the jaw slot 142 between the housing legs 144, and is rotatably pinned therein by inserting the jaw pivot 114 into a jaw pivot bore 146 defined in the housing legs 144, and also into a jaw bore 148 defined in each jaw 104. The jaws 104 are thereby pivotally mounted with respect to the housing 102, with the jaw spring 124 attempting to bias the jaws 104 towards an open state, and with such biasing ordinarily being defeated by the forward biasing of the cam 106 by the cam spring 132 (see FIG. 1C).

Looking again to FIG. 1B, the cam 106 and trigger 108 may then be installed within the housing 102. The trigger adjustment member 136 can first be inserted within the trigger 108, and is preferably adjusted to such an extent that it does not extend from the trigger 108 into the trigger slot 122. The trigger cam pivot 120 is inserted within a cam bore 150, and the cam 106 is inserted into the housing 102 from its open rear until its cam driving surface 116 rests between the jaw tail ends 112 (see FIG. 1C). The trigger 108 is inserted through a bottom housing slot 152 (FIG. 1C) and into the cam slot 128 (FIG. 1B) in the cam 106, with the top of the trigger 108 being "hooked" over the trigger cam pivot 120 in the manner shown in FIG. 1C such that the trigger cam pivot 120 rests in the trigger slot 122. (It should be kept in mind that contrary to FIG. 1C, at this point the trigger adjustment member 136 is preferably inserted into the trigger 108 to such an extent that it does not rest within the trigger slot 122, and thus the trigger adjustment member 136 does not interfere with the insertion of the trigger cam pivot 120 into the trigger slot 122.) The trigger housing pivot 118 is inserted within a trigger pivot bore 154 (FIG. 1B) in the housing 102, to extend across the cam channel 130 (see FIG. 1C) and into a trigger bore 156 (FIG. 1B) in the trigger 108, with the trigger housing pivot 118 thereby rotatably pinning the trigger 108 with respect to the housing 102.

Referring again to FIG. 1B, the cam spring 132 (if desired) may then be inserted within the rear opening of the housing 102 to bear against the rear cam surface 134. Each of the cam legs 126 preferably bears a spring land 158, with each spring land 158 being defined by a sector of a cylinder, so that the (helical) cam spring 132 complementarily fits about the spring lands 158. The release mount 138 is inserted into the rear opening in the housing 102, and the release mount 138 bears a forwardly-extending plug 160 with an annular channel 162 situated along its length, and a cylindrical land 164 at its end. The cam spring 132 therefore extends from the spring lands 158 on the cam 106 to complementarily fit about the cylindrical land 164 on the release mount 138. (In FIG. 1B, a washer 166—which is optional—is also shown fit about the cylindrical land 164, with the washer 166 being interposed between the plug 160 and the cam spring 132.) The release mount plug 160 is urged forwardly into the housing 102 until the annular channel 162 is aligned with a pair of release mount bores 168 situated near the rear of the housing 102. Release mount pins 170 are inserted within the release mount bores 168 and into the annular channel 162 within the release mount plug 160 (see FIG. 1C). The release mount plug 160 is thereby pinned within the housing 102 such that the release mount plug 160, and thus the release mount 138, are rotatably mounted to the housing 102. In this manner, when the release mount 138 is affixed to a wrist band/wrist strap, a glove, or other arm mounting means, the housing 102 can be rotated with respect to the release mount 138 into an orientation preferred by the archer.

Figure 1D:
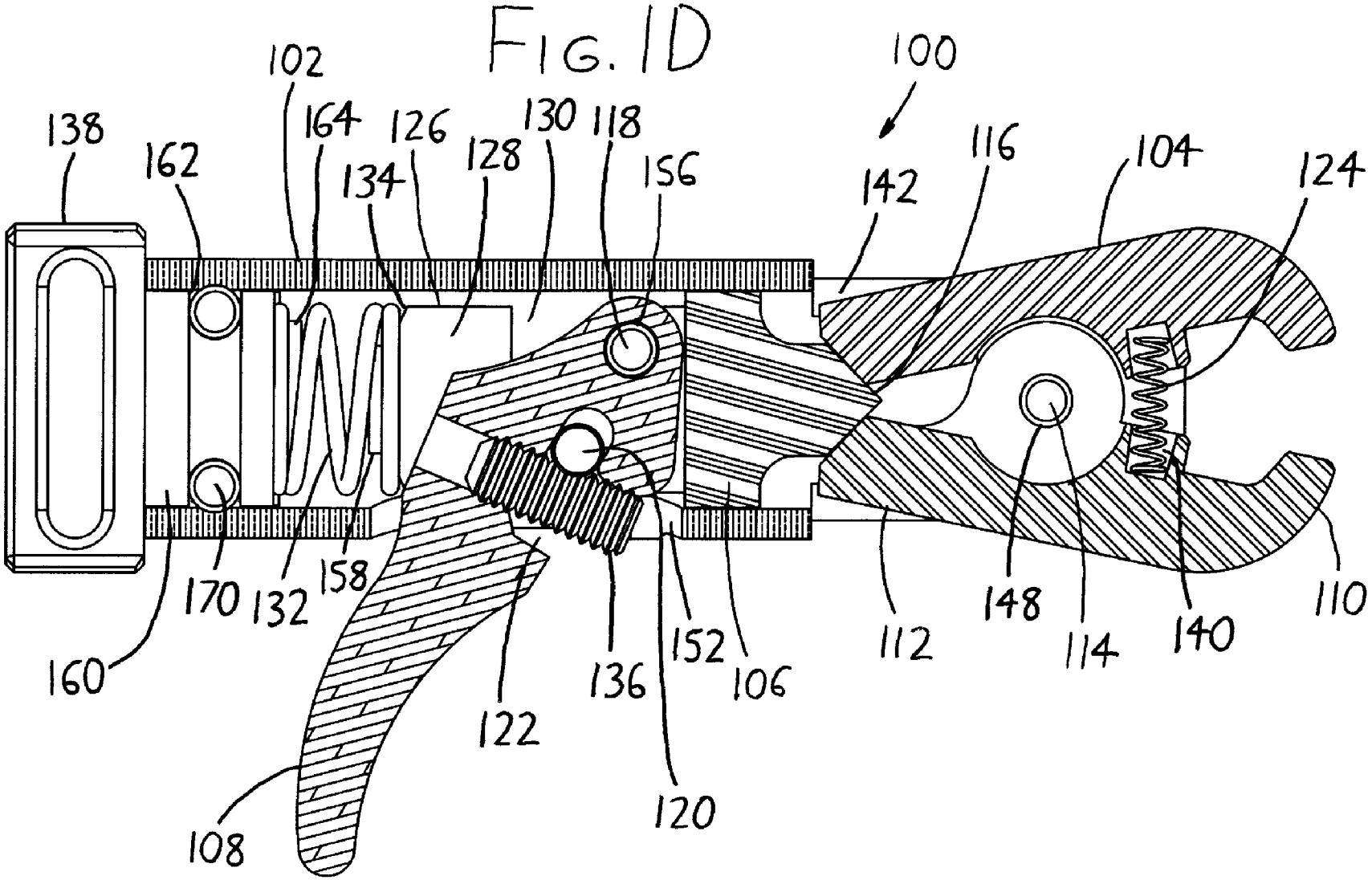
FIG. 1D is another sectional view of the bowstring release 100 corresponding to FIG. 1C, but wherein the trigger 108 has been pulled to open the jaws 104.

When the bowstring release 100 is assembled in this manner, it essentially takes the form shown in FIG. 1A. The trigger adjustment member 136 may then be adjusted by the archer as desired, as by pulling back the trigger (see FIG. 1D) and adjusting the trigger adjustment member 136 to the desired degree of extension. The archer may then pull the trigger 108 (see FIG. 1C) to open the jaws 104 and insert a bowstring therein; release the trigger 108 (see FIG. 1B) to close the jaws 104 about the bowstring; and then pull the trigger 108 when desired to release the bowstring.

Turning next to the bowstring release 200 shown in FIGS. 2A-2D, the release 200 has structure and operation fundamentally similar to that of the bowstring release 100 of FIGS. 1A-1D. However, its housing 202 includes a forward housing section 272 which bears the jaws 204, and which is rotatable about the longitudinal axis of the release 200 with respect to a rear housing section 274 which bears the trigger 208. As a result, a user can rotate the forward housing section 272 (and the jaws 204) to any desired angle with respect to the rear housing section 274 (and thus with respect to the trigger 208 and the release mount 238). Similarly to the bowstring release 100, a release mount 238 is itself rotatably mounted with respect to the housing 202 (more specifically the rear housing section 274), thereby allowing the rear housing section 274 to be angled as desired with respect to a wrist band/wrist strap, glove, handle, or other arm mounting means for mounting the release 200 to a user's wrist, hands, or arm.

Figure 2A:
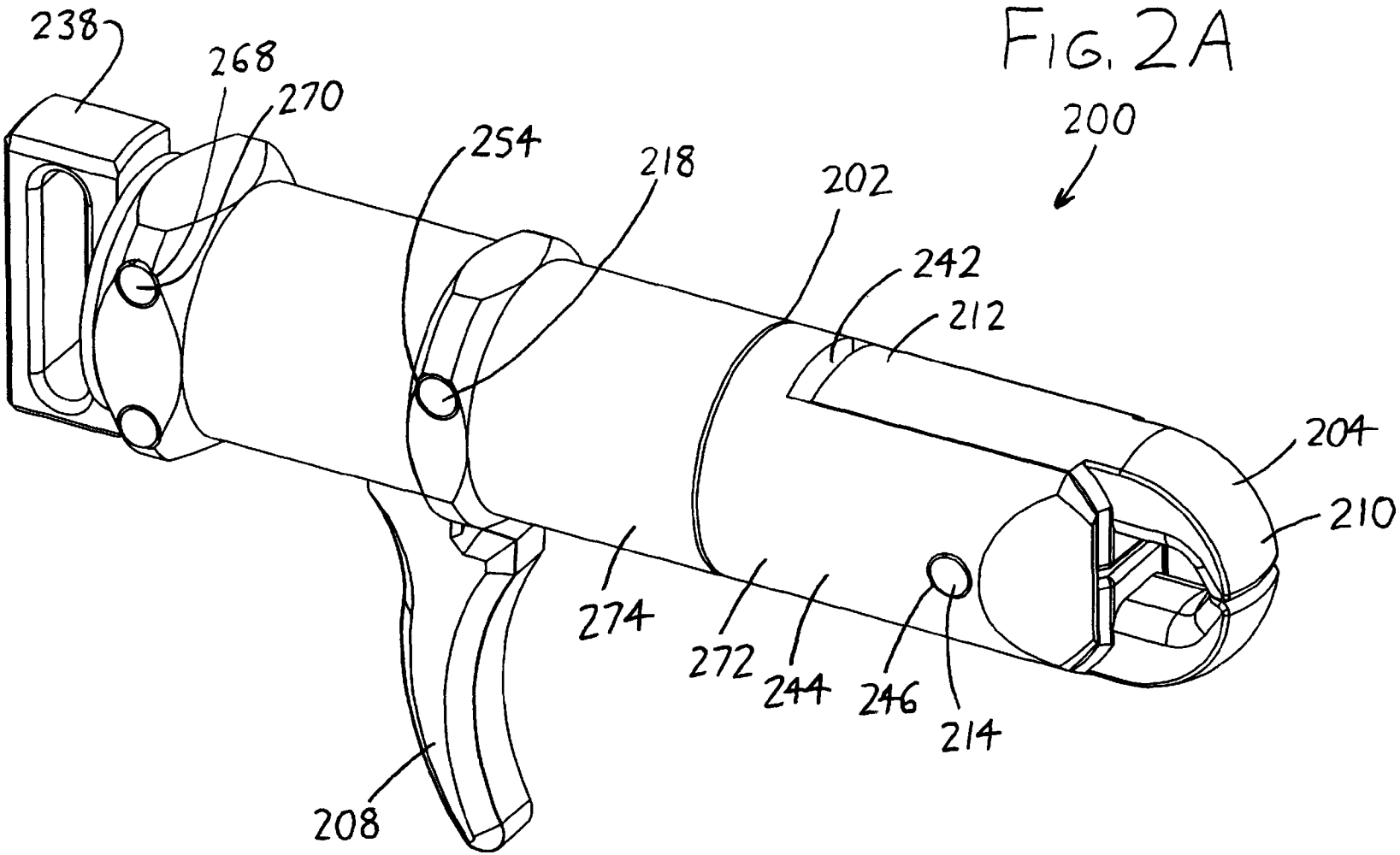
FIG. 2A is a simplified perspective view of a second version of a bowstring release 200 exemplifying the invention, showing the jaws 204 in a closed state before the trigger 208 is pulled.
Figure 2B:
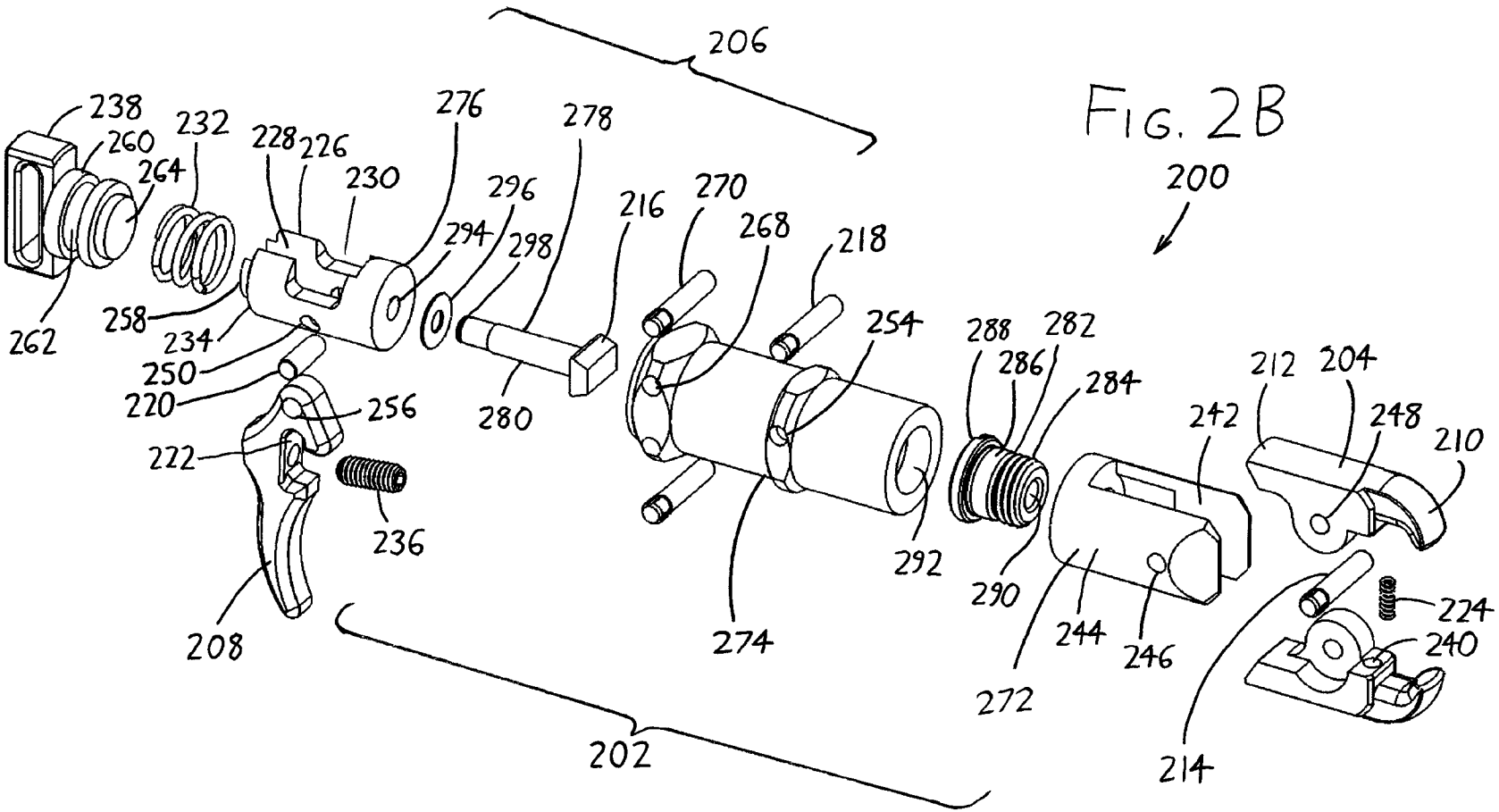
FIG. 2B is an "exploded" (disassembled) view of the bowstring release 200 of FIG. 2A.
Figure 2C:
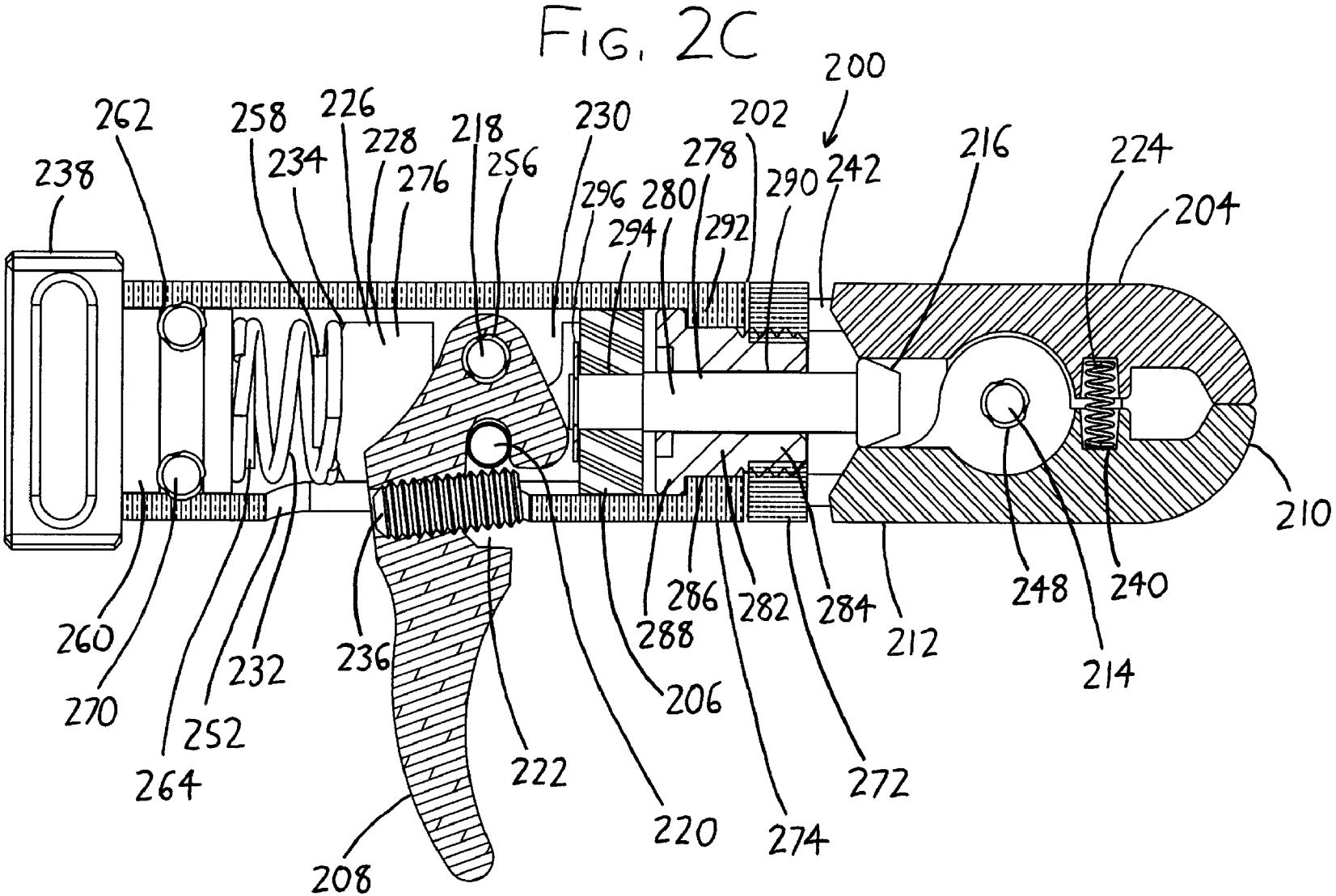
FIG. 2C is a sectional view of the bowstring release 200 of FIG. 2A, showing the bowstring release 200 bisected along a plane extending along the length of the bowstring release 200, and showing the jaws 204 in a closed state before the trigger 208 is pulled.

The assembly of the bowstring release 200 will now be discussed with primary reference to FIG. 2B. The jaws 204 are fit together in mated relationship with the jaw spring 224 situated therebetween in jaw spring mounts 240 provided on each jaw 204. The interfit jaws 204 are then fit within the housing jaw slot 242 defined between the housing legs 244 on the forward housing section 272. The jaw pivot 214 is inserted within the jaw pivot bore 246 defined in each of the housing legs 144, and through the jaw bore 248 in each of the jaws 204, to rotatably pin the jaws 204 to the forward housing section 272.

The cam 206 is then installed within the housing 202. The cam 206 is here provided in two main parts: a cam rear section 276 which resembles the bulk of the cam 106 of the bowstring release 100, and a cam forward section 278 which resembles an elongated ram extending from the cam rear section 276. The cam forward section 278 bears the cam driving surface 216 thereon, and includes a cam shaft 280 extending rearwardly from the cam driving surface 216 to join to the cam rear section 276. The cam forward section 278 is installed within the forward housing section 272 first, with the cam driving surface 216 being fit between the jaw tail ends 212, and with the cam shaft 280 extending rearwardly. A housing swivel 282 is then used to rotatably affix the forward housing section 272 to the rear housing section 274, with the cam forward section 278 (more specifically its cam shaft 280) being translatably received within the housing swivel 282. Looking to FIG. 2C in combination with FIG. 2B, the housing swivel 282 includes a smaller-diameter threaded forward end 284, a cylindrical midsection 286, an enlarged rear end 288, and a central bore 290. The housing swivel 282 is inserted into the rear of the rear housing section 274 until its enlarged rear end 288 encounters a land 292 (FIG. 2C) extending radially inwardly at the forward end of the rear housing section 274, such that the cylindrical midsection 286 of the housing swivel 282 is rotatably mounted within the rear housing section 274. The threaded forward end 284 of the housing swivel 282 then protrudes forwardly from the rear housing section 274. The cam shaft 280 is inserted rearwardly into the central bore 290 of the housing swivel 282, and the rear end of the forward housing section 272 is threaded onto the threaded end 284 of the housing swivel 282 with the cam driving surface 216 fit between the jaw tail ends 212. In this manner, the forward housing section 272 (and its jaws 204 and threadedly-attached housing swivel 282) are rotatably mounted with respect to the rear housing section 274, with the cam forward section 278 (and its cam shaft 280 and cam driving surface 216) being translatably and rotatably situated within the central bore 290 of the housing swivel 282.

Turning back to FIG. 2B, the trigger cam pivot 220 can then be inserted within the cam bore 250 of the cam rear section 276. The cam rear section 276 is then inserted into the rear housing section 274 from its rear end until the cam shaft 280 of the cam forward section 278 is received within a shaft bore 294 provided in the forward end of the cam rear section 276. A snap washer 296 may then be installed within a groove 298 at the end of the cam shaft 280 so that the cam forward section 278 is effectively rotatably engaged to the cam rear section 276. If desired, other means for affixing the cam shaft 280, and thus the cam forward section 278, to the cam rear section 276 may be used, though it is preferred in any event that the cam shaft 280 and cam forward section 278 be rotatably mounted with respect to the cam rear section 276.

The trigger 208 is then inserted within the bottom housing slot 252 (FIG. 2D), and into the cam slot 228 (FIG. 2B) between the cam legs 226, such that the trigger 208 hooks over the trigger cam pivot 220 to situate the trigger cam pivot 220 within the trigger slot 222. The trigger housing pivot 218 is inserted within the trigger pivot bore 254 in the rear housing section 274 to extend across the cam channel 230 in the cam rear section 276, and to extend within the trigger bore 256 in the trigger 208, so that the trigger 208 is rotatably pinned with respect to the rear housing section 274.

The cam spring 232 (if desired) may then be inserted into the rear housing section 274 to complementarily fit about the spring land 258, and the release mount plug 260 of the release mount 238 can in turn be inserted into the rear housing section 274 to sandwich the cam spring 232 between the cam rear section 276 and the cylindrical land 264 of the release mount 238. Release mount pins 270 are inserted within the release mount bores 268 at the rear of rear housing section 274, and into the annular channel 262 in the release mount plug 260, to pin the release mount 238 in the rear housing section 274 so that it may rotate therein.

Figure 2D:
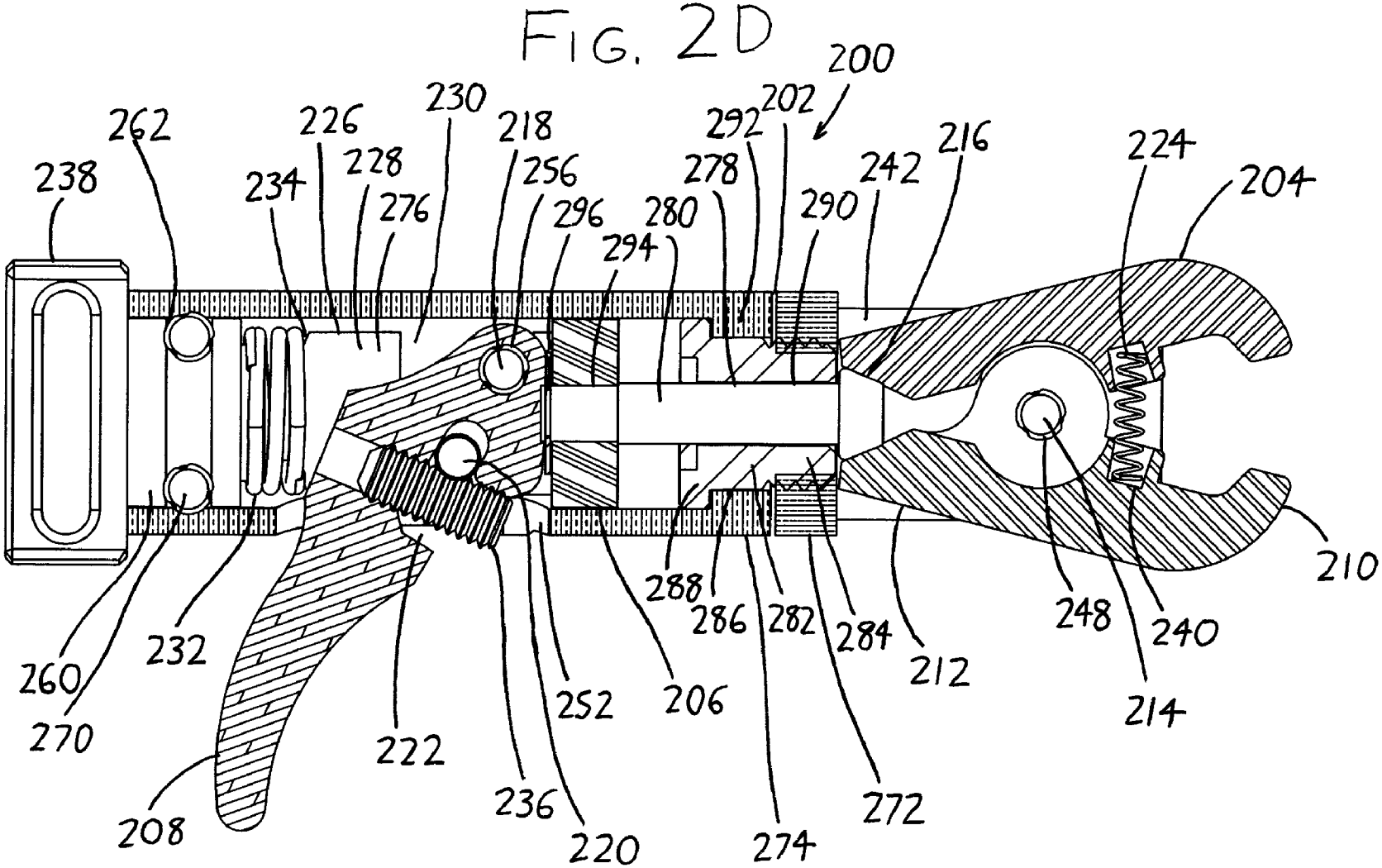
FIG. 2D is another sectional view of the bowstring release 200 corresponding to FIG. 2C, but wherein the trigger 208 has been pulled to open the jaws 204.

Looking then in particular to FIG. 2D, the trigger adjustment member 236 can be unscrewed or otherwise extended from the trigger 208 to a desired degree, or may be installed as desired within the trigger 208, to adjust the degree of trigger pull. The bowstring release 200 is then ready for use.

Preferred versions of the invention have been described above in order to illustrate how to make and use the invention. The invention is not intended to be limited to these versions, but rather is intended to be limited only by the claims set out below, with the invention encompassing all different versions that fall literally or equivalently within the scope of these claims. Thus, it should be understood that the invention can be provided in forms having appearances and features different from the exemplary versions described above. As one example, attachments/linkages between parts may be reversed to provide equivalent arrangements, e.g., rather than the cam bearing a trigger cam pivot which rotates and translates within a trigger slot in the trigger, the trigger might bear the trigger cam pivot which rides in a slot in the cam, in such a manner that the same effect is provided. As another example, bowstring releases in accordance with the invention can also incorporate features known from prior releases, e.g., the releases of the patents noted earlier in this document, or still other features.

What is claimed is:

1. An archery bowstring release including:
a. a pair of jaws, each jaw having a jaw tip end and a jaw tail end, the jaws being rotationally fixed at a common jaw pivot, whereby the jaws rotate about the jaw pivot such that the jaw tip ends move apart as the jaw tail ends move together;
b. a cam having:
(1) a driving surface fit between the jaw tail ends,
(2) a pair of rearwardly extending cam legs, each leg having an elongated cam channel therein, with the cam's driving surface being situated between the cam legs and the iaw tail ends,
(3) a cam slot defined between the cam legs,
wherein the jaw tail ends move together when the driving surface moves away from the jaw tail ends;
c. a trigger:
(1) fit within the cam slot, and
(2) being pivotally actuatable about a trigger housing pivot situated:
(a) at a fixed location with respect to the iaw pivot, and
(b) within the cam channel,
to urge the cam away from the jaw tail ends.

2. The archery bowstring release of claim 1 wherein the trigger is:
a. rotationally fixed to a trigger housing pivot, the trigger housing pivot being situated at a fixed location with respect to the jaw pivot; and
b. rotationally linked to the cam at a trigger cam pivot spaced from the trigger housing pivot,
wherein rotating the trigger about the trigger housing pivot translates the cam with respect to the jaws.

3. The archery bowstring release of claim 2:
a. wherein the trigger cam pivot rides within a trigger slot defined in the trigger, and
b. further including a cam spring urging the cam toward the jaw tail ends.

4. The archery bowstring release of claim 3 wherein the trigger slot is defined in the outer surface of the trigger.

5. The archery bowstring release of claim 1 further including a housing wherein:
a. the jaws are rotationally fixed to the housing at the jaw pivot;
b. the trigger is rotationally fixed to the housing at a trigger housing pivot; and
c. the cam is at least partially situated within the housing.

6. The archery bowstring release of claim 5 wherein:
a. the housing includes:
(1) a rear housing section to which the trigger is rotationally fixed by the trigger housing pivot, and
(2) a forward housing section to which the jaws are rotationally fixed by the jaw pivot, and
b. the forward housing section is rotatable with respect to the rear housing section.

7. The archery bowstring release of claim 5 wherein the cam is rotationally linked to the trigger at a trigger cam pivot spaced from the trigger housing pivot.

8. The archery bowstring release of claim 7 wherein the trigger cam pivot rides within a trigger slot defined in the trigger.

9. The archery bowstring release of claim 8 wherein the trigger slot is defined in the outer surface of the trigger.

10. The archery bowstring release of claim 5 further including a cam spring urging the cam toward the jaw tail ends.

11. The archery bowstring release of claim 1 wherein the cam bears a cam slot wherein the trigger is fit.

12. The archery bowstring release of claim 1 wherein:
a. a trigger cam pivot extends through the cam slot between the cam legs, and
b. a trigger slot is defined in the trigger, wherein the trigger cam pivot is situated.

13. The archery bowstring release of claim 12 wherein the cam channels are defined in the outer surface of the cam.

14. An archery bowstring release including:
a. a housing;
b. a pair of jaws rotationally fixed to the housing, each jaw having a jaw tip end and a jaw tail end, wherein the jaws rotate with respect to the housing such that the jaw tip ends move apart as the jaw tail ends move together;
c. a cam having:
(1) a driving surface fit between the jaw tail ends, and
(2) a cam slot defined between a pair of cam legs extending rearwardly away from the cam driving surface, each leg having an elongated cam channel therein;
d. a trigger:

(1) situated within the cam slot,
(2) rotationally fixed to the housing at a trigger housing pivot situated within the cam channel, and
(3) rotationally linked to the cam at a trigger cam pivot spaced from the trigger housing pivot, the trigger cam pivot riding within a trigger slot defined in the trigger,
wherein rotating the trigger about the trigger housing pivot translates the cam with respect to the jaws.

15. The archery bowstring release of claim 14 wherein:
a. the housing includes:
(1) a rear housing section to which the trigger is rotationally fixed by the trigger housing pivot, and
(2) a forward housing section to which the jaws are rotationally fixed, and
b. the forward housing section is rotatable with respect to the rear housing section.

16. The archery bowstring release of claim 14 wherein the trigger slot is defined in the outer surface of the trigger.

17. The archery bowstring release of claim 14 wherein the trigger cam pivot extends between the cam legs.

18. The archery bowstring release of claim 14 wherein the jaws are rotationally fixed to the housing at a common jaw pivot.

19. An archery bowstring release including:
a. a pair of jaws rotationally mounted with respect to each other, each jaw having a jaw tip end and a jaw tail end;
b. a cam having:
(1) a pair of cam legs with:
(a) a cam slot situated therebetween, and
(b) each leg having an elongated cam channel defined thereon;
(2) a driving surface:
(a) fit between the jaw tail ends, wherein motion of the driving surface between the jaw tail ends moves the jaws about the jaw pivot, and
(b) situated between the cam legs and the jaw tail ends;
c. a trigger:
(1) rotationally linked to a trigger housing pivot extending within the cam channel and across the cam legs at a fixed location with respect to the jaw pivot, and
(2) rotationally linked to the cam within the cam slot at a trigger cam pivot extending between the cam legs and spaced from the trigger housing pivot,
wherein rotating the trigger about the trigger housing pivot moves the cam with respect to the jaws.

20. The archery bowstring release of claim 19 further including:
a. a rear housing section to which the trigger is rotationally linked by the trigger housing pivot, and
b. a forward housing section to which the jaws are rotationally mounted,
wherein:
(1) the cam is at least partially situated within the rear housing section and the forward housing section, and
(2) the forward housing section is rotatable with respect to the rear housing section.

21. The archery bowstring release of claim 19 wherein the trigger cam pivot is situated on the cam to move with the cam.

22. The archery bowstring release of claim 19 wherein the trigger cam pivot rides within a trigger slot defined in the trigger.

23. An archery bowstring release including:
a. a housing;
b. a pair of jaws rotationally fixed with respect to the housing, each jaw having a jaw tip end and a jaw tail end;
c. a cam movable with respect to the housing, the cam having:
(1) a driving surface fit between the jaw tail ends, wherein each jaw tail end is urged by the driving surface with respect to the other jaw tail end when the cam moves within the housing;
(2) an elongated cam channel defined therein;
(3) a trigger cam pivot extending therefrom; and
(4) a pair of rearwardly-extending cam legs defining a cam slot therebetween:
d. a trigger actuatable to urge the cam away from the jaw tail ends, wherein:
(1) the trigger is pivotally mounted within the cam slot to a trigger housing pivot:
(a) fixed with respect to the housing, and
(b) situated within the cam channel;
(2) the trigger bears an elongated trigger slot therein, wherein the trigger cam pivot is rotatably and translatably situated within the trigger slot.

* * * * *